US011817666B2

(12) United States Patent
Ho

(10) Patent No.: US 11,817,666 B2
(45) Date of Patent: Nov. 14, 2023

(54) ELECTRICAL CONNECTOR AND METHOD OF MANUFACTURING THE SAME

(71) Applicant: LOTES CO., LTD, Keelung (TW)

(72) Inventor: Chien Chih Ho, Keelung (TW)

(73) Assignee: LOTES CO., LTD, Keelung (TW)

( * ) Notice: Subject to any disclaimer, the term of this patent is extended or adjusted under 35 U.S.C. 154(b) by 238 days.

(21) Appl. No.: 17/533,262

(22) Filed: Nov. 23, 2021

(65) Prior Publication Data

US 2022/0200223 A1 Jun. 23, 2022

(30) Foreign Application Priority Data

Dec. 18, 2020 (CN) ..... 202011506223.7

(51) Int. Cl.

| | |
|---|---|
| ***H01R 13/24*** | (2006.01) |
| ***H01R 43/18*** | (2006.01) |
| ***H01R 13/50*** | (2006.01) |
| *H01R 33/74* | (2006.01) |

(52) U.S. Cl.

CPC ..... *H01R 43/18* (2013.01); *H01R 13/24* (2013.01); *H01R 13/2442* (2013.01); *H01R 13/50* (2013.01); *H01R 33/74* (2013.01)

(58) Field of Classification Search

CPC .... H01R 43/18; H01R 13/2442; H01R 13/50; H01R 43/24; H01R 33/74; H01R 2107/00; H01R 12/7076; H01R 12/716; H01R 12/73; H01R 13/02

See application file for complete search history.

(56) References Cited

U.S. PATENT DOCUMENTS

| | | | | |
|---|---|---|---|---|
| 6,585,527 B2 * | 7/2003 | Koopman | ..... | H01R 13/2435 439/71 |
| 6,749,440 B1 * | 6/2004 | Szu | ..... | H01R 12/714 439/515 |
| 6,926,536 B2 * | 8/2005 | Ochiai | ..... | H01R 43/16 439/91 |

(Continued)

FOREIGN PATENT DOCUMENTS

| | | |
|---|---|---|
| CN | 101483287 B | 5/2012 |
| CN | 110165449 A | 8/2019 |

*Primary Examiner* — Abdullah A Riyami
*Assistant Examiner* — Nelson R. Burgos-Guntin
(74) *Attorney, Agent, or Firm* — Locke Lord LLP; Tim Tingkang Xia, Esq.

(57) ABSTRACT

An electrical connector includes an insulating body, and multiple terminals and a base plate insert-molded with the insulating body. The insulating body has an outer side edge. Multiple grooves are concavely provided inward from the outer side edge. Two protruding blocks protrude toward each other and inward each of the grooves from two opposite sides of each of the grooves. The base plate has multiple strip connecting portions. Prior to the insert-molding, the strip connecting portions are integrally connected to a same strip. After the insert-molding, the strip connecting portions are broken from the strip, each strip connecting portion is located in a corresponding groove, and upper and lower surfaces of each strip connecting portion are exposed in the corresponding groove. The strip connecting portions do not exceed outward beyond the outer side edge. Two opposite sides of each strip connecting portion abut the two protruding blocks.

13 Claims, 10 Drawing Sheets

(56) References Cited

U.S. PATENT DOCUMENTS

| | | | | |
|---|---|---|---|---|
| 6,942,495 | B2 * | 9/2005 | Liao | H01R 13/2435 439/71 |
| 7,988,501 | B2 * | 8/2011 | Chang | H05K 7/1069 439/873 |
| 8,007,287 | B1 * | 8/2011 | Champion | H05K 1/141 439/66 |
| 8,911,242 | B2 * | 12/2014 | Jeon | H01R 13/2442 439/66 |
| 10,381,755 | B2 * | 8/2019 | Chang | H05K 3/3436 |
| 11,217,955 | B1 * | 1/2022 | Ho | H01R 43/16 |
| 2020/0328550 | A1 * | 10/2020 | Chen | H01R 12/714 |
| 2021/0305754 | A1 * | 9/2021 | Ho | H01R 12/7082 |
| 2022/0200184 | A1 * | 6/2022 | Ho | H01R 13/2442 |
| 2022/0200223 | A1 * | 6/2022 | Ho | H01R 13/50 |
| 2022/0209442 | A1 * | 6/2022 | Liu | H01R 12/7076 |
| 2022/0239024 | A1 * | 7/2022 | Tsai | H01R 43/0256 |
| 2023/0039986 | A1 * | 2/2023 | Huang | H01R 43/16 |
| 2023/0070662 | A1 * | 3/2023 | Jin | H01R 43/007 |
| 2023/0075216 | A1 * | 3/2023 | Jin | H01R 43/16 |

* cited by examiner

B-B

ELECTRICAL CONNECTOR AND METHOD OF MANUFACTURING THE SAME

CROSS-REFERENCE TO RELATED PATENT APPLICATION

This non-provisional application claims priority to and the benefit of, pursuant to 35 U.S.C. § 119(a), patent application Serial No. CN202011506223.7 filed in China on Dec. 18, 2020. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector and a method of manufacturing the same, and particularly to an electrical connector electrically connecting a chip module and a circuit board and a method of manufacturing the same.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An existing electrical connector includes an insulating body and a metal sheet. The metal sheet is provided horizontally and is insert-molded with the insulating body. The metal sheet is cut and bends to form a plurality of terminals, and the terminals are accommodated in the insulating body. The metal sheet has a plurality of strip connecting portions. Prior to the insert-molding, the strip connecting portions are integrally connected to a same strip. After the insert-molding, the strip connecting portions are broken from the strip. To prevent the broken strip connecting portions from scratching the working staffs or being scratched by outer objects caused by protruding out of an outer side edge of the insulating body, the broken strip connecting portions do not exceed outward beyond the outer side edge of the insulating body, and the two opposite sides of each strip connecting portion abut the insulating body. However, when the strip is shaking vertically to be broken, the two opposite sides of each strip connecting portion strongly apply forces to the insulating body, thereby causing damages to the insulating body to a certain degree. To solve this issue, in another existing electrical connector, the strip connecting portions protrude out of the outer side edge of the insulating body, and when the strip is broken, the strip connecting portions are not in contact with the insulating body, thereby not damaging the insulating body and achieving the objective to protect the insulating body. However, with the strip connecting portions protruding out of the outer side edge of the insulating body, the strip connecting portions may easily be scratched by the outer objects, or the strip connecting portions may easily scratch the working staffs.

Therefore, a heretofore unaddressed need to design a novel electrical connector and a method of manufacturing the same exists in the art to address the aforementioned deficiencies and inadequacies.

SUMMARY

In view of the deficiency of the background, the present invention is directed to an electrical connector and a method of manufacturing the same, such that the whole structure of the insulating body is not affected by breaking the strip, and preventing the strip connecting portions from being scratched by outer objects or scratching the working staffs.

To achieve the foregoing objective, the present invention adopts the following technical solutions.

An electrical connector is configured to electrically connect a first mating component and a second mating component. The electrical connector includes: an insulating body, located above the second mating component, wherein an upper surface of the insulating body has a plurality of upper openings, a lower surface of the insulating body has a plurality of lower openings, the insulating body has an outer side edge, a plurality of grooves are concavely provided inward from the outer side edge, the grooves run vertically through the insulating body, and two protruding blocks protrude toward each other and inward each of the grooves from two opposite sides of each of the grooves; and a plurality of terminals arranged in a plurality of rows and a plurality of columns and a base plate, collectively formed by cutting from a metal plate, wherein the terminals and the base plate are insert-molded with the insulating body, and the base plate is provided horizontally; wherein each of the terminals has a base portion and an elastic arm connected to the base portion, the base portion is provided to be at least partially horizontal and co-planar to the base plate, the base portion has a conductive portion configured to be conductively connected to the second mating component, the conductive portion is exposed downward to a corresponding one of the lower openings, the elastic arm bends upward and is exposed upward to a corresponding one of the upper openings to be in upward contact with the first mating component, the base plate has a plurality of strip connecting portions, and prior to the insert-molding, the strip connecting portions are integrally connected to a same strip; and wherein after the insert-molding, the strip connecting portions are broken from the strip, each of the strip connecting portions is located in a corresponding one of the grooves, an upper surface and a lower surface of each of the strip connecting portions are exposed in the corresponding one of the grooves, the strip connecting portions do not exceed outward beyond the outer side edge, and two opposite sides of each of the strip connecting portions abut the two protruding blocks.

In certain embodiments, an upper surface of each of the protruding blocks is flush with the upper surface of each of the strip connecting portions, a lower surface of each of the protruding blocks is flush with the lower surface of each of the strip connecting portions, and a tail end of each of the protruding block is flush with the outer side edge.

In certain embodiments, the insulating body is provided with a plurality of through holes running vertically through the insulating body; a cutting slot is formed between the base plate and the base portion by cutting the base portion, a through slot is formed between the base plate and the elastic arm by cutting the elastic arm, and the cutting slot and the through slot are respectively U-shaped and provided opposite to each other; and the elastic arm is exposed in a corresponding one of the through holes, the cutting slot is filled by the insulating body, and a portion of the cutting slot is exposed in the corresponding one of the through holes.

In certain embodiments, two opposite side edges of the base portion along a width direction thereof are respectively defined as two first side edges, two opposite side edges of the elastic arm along a width direction thereof are respectively defined as two second side edges, a side edge of the cutting slot opposite to a corresponding one of the two first side edges is defined as a third side edge, a side edge of the through slot opposite to a corresponding one of the two second side edges is defined as a fourth side edge, and a distance between the corresponding one of the two first side edges and the third side edge is greater than a distance between the corresponding one of the two second side edges and the fourth side edge.

In certain embodiments, the elastic arm comprises a wide portion and a narrow portion connected to the wide portion, the narrow portion is configured to be in upward contact with the first mating component, a width of the wide portion is greater than a width of the narrow portion, and a width of the base portion is less than the width of the wide portion; and the third side edge passes outward beyond the fourth side edge along the width direction of the base portion, the base portion and the narrow portion of an adjacent terminal of the terminals are arranged along the width direction of the base portion, and the base portion and the wide portion of the adjacent terminal are staggered.

In certain embodiments, the terminals comprise a plurality of signal terminals and a plurality of ground terminals, the through slot and the cutting slot corresponding to each of the signal terminals are in communication, the through slot and the cutting slot corresponding to each of the ground terminals are not in communication, the base plate forms a connecting portion between the through slot and the cutting slot corresponding to each of the ground terminals to be connected to the elastic arm, and an edge of each of the through holes is spaced apart from the through slot.

In certain embodiments, the base portion comprises a first portion being horizontal and a second portion formed by bending perpendicularly from the first portion and extending downward, the insulating body has an insulating block surrounding the second portion, the insulating body is provided with a slot around the insulating block, the first portion is partially exposed to the slot, the insulating block gradually becomes larger along an upward direction from a bottom thereof, and a portion of the second portion protruding out of the insulating block forms the conductive portion.

In addition, to achieve the foregoing objective, the present invention further adopts the following technical solutions.

An electrical connector is configured to electrically connect a first mating component and a second mating component. The electrical connector includes: an insulating body, having an outer side edge, wherein a plurality of grooves are concavely provided inward from the outer side edge, the grooves run vertically through the insulating body, and two protruding blocks protrude toward each other and inward each of the grooves from two opposite sides of each of the grooves; and a metal sheet, insert-molded with the insulating body, wherein the metal sheet has a plurality of strip connecting portions, prior to the insert-molding, the strip connecting portions are integrally connected to a same strip; and after the insert-molding, the strip connecting portions are broken from the strip, each of the strip connecting portions is located in a corresponding one of the grooves, an upper surface and a lower surface of each of the strip connecting portions are exposed in the corresponding one of the grooves, the strip connecting portions do not exceed outward beyond the outer side edge, and two opposite sides of each of the strip connecting portions abut the two protruding blocks; wherein the metal sheet is cut to form a plurality of terminals, configured to mate with at least one of the first mating component and the second mating component.

In certain embodiments, an upper surface of each of the protruding blocks is flush with the upper surface of each of the strip connecting portions, a lower surface of each of the protruding blocks is flush with the lower surface of each of the strip connecting portions, and a tail end of each of the protruding block is flush with the outer side edge.

In certain embodiments, the terminals are arranged in a plurality of rows and a plurality of columns, an upper surface of the insulating body has a plurality of upper openings, a lower surface of the insulating body has a plurality of lower openings, each of the terminals has a conductive portion configured to be conductively connected to the second mating component, the conductive portion is exposed downward to a corresponding one of the lower openings, each of the terminals further has an elastic arm configured to be in upward contact with the first mating component, and the elastic arm bends upward and is exposed upward to one of the upper openings.

In addition, to achieve the foregoing objective, the present invention further adopts the following technical solutions.

A method of manufacturing an electrical connector is provided. The electrical connector is configured to electrically connect a first mating component and a second mating component. The method includes:

step 1: providing a metal plate in a flat plate shape, cutting a strip and a metal sheet on the metal plate, and cutting a plurality of terminals, and a plurality of strip connecting portion integrally connected to the strip on the metal sheet, wherein the terminals are configured to mate with one of the first mating component and the second mating component;

step 2: placing the metal sheet to a mold such that each of a plurality of upper protruding posts of the mold covers an upper surface of a corresponding one of the strip connecting portions and passes horizontally beyond two opposite sides of the corresponding one of the strip connecting portions, and each of a plurality of lower protruding posts of the mold covers a lower surface of the corresponding one of the strip connecting portions and passes horizontally beyond the two opposite sides of the corresponding one of the strip connecting portions; and forming an insulating body on the metal sheet by insert-molding; and step 3: after the step 2, breaking the strip connecting portions and removing the strip, wherein a breaking position does not exceed outward beyond an outer side edge of the insulating body.

In certain embodiments, each of the terminals has a base portion and an elastic arm connected to the base portion, the elastic arm is configured to be in contact with the first mating component, and the base portion has a conductive portion to be conductively connected to the second mating component; in the step 1, the base portion is cut on the metal plate, thereby forming a cutting slot on the metal plate, and the cutting slot surrounds a side edge of the base portion; and prior to the insert-molding, each pair of a plurality of pairs of positioning posts of the mold clamp the elastic arm vertically and cover a portion of the cutting slot, thereby forming a plurality of through holes on the insulating body on the insulating body after the insert-molding, and each of the through holes exposes the corresponding elastic arm and the portion of the cutting slot.

In certain embodiments, in the step 1, the elastic arm is cut on the metal plate, thereby forming a through slot on the metal plate, and the through slot surrounds a side edge of the base portion; and in the step 2, when the positioning posts clamp the elastic arm, the positioning posts further cover the through slot and exceed horizontally beyond the through slot, thereby separating an edge of the through hole from the through slot after the insert-molding.

Compared with the related art, certain embodiments of the present invention has the following beneficial effects. Two protruding blocks protrude opposite to each other from the two opposite sides of each groove, and the two protruding blocks abut the two opposite sides of a corresponding strip connecting portion. When the strip is removed, the damages caused by the acting forces applied are absorbed by the two protruding blocks (that is, when the strip is removed, only the protruding blocks are damaged, and it does not matter whether the protruding blocks are damaged), thus not affecting the whole structure of the insulating body. Further, each strip connecting portion is located in a corresponding groove, and the strip connecting portions do not exceed outward beyond the outer side edge, thus preventing the strip connecting portions from being scratched by outer objects, and preventing the strip connecting portions from scratching the working staffs.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
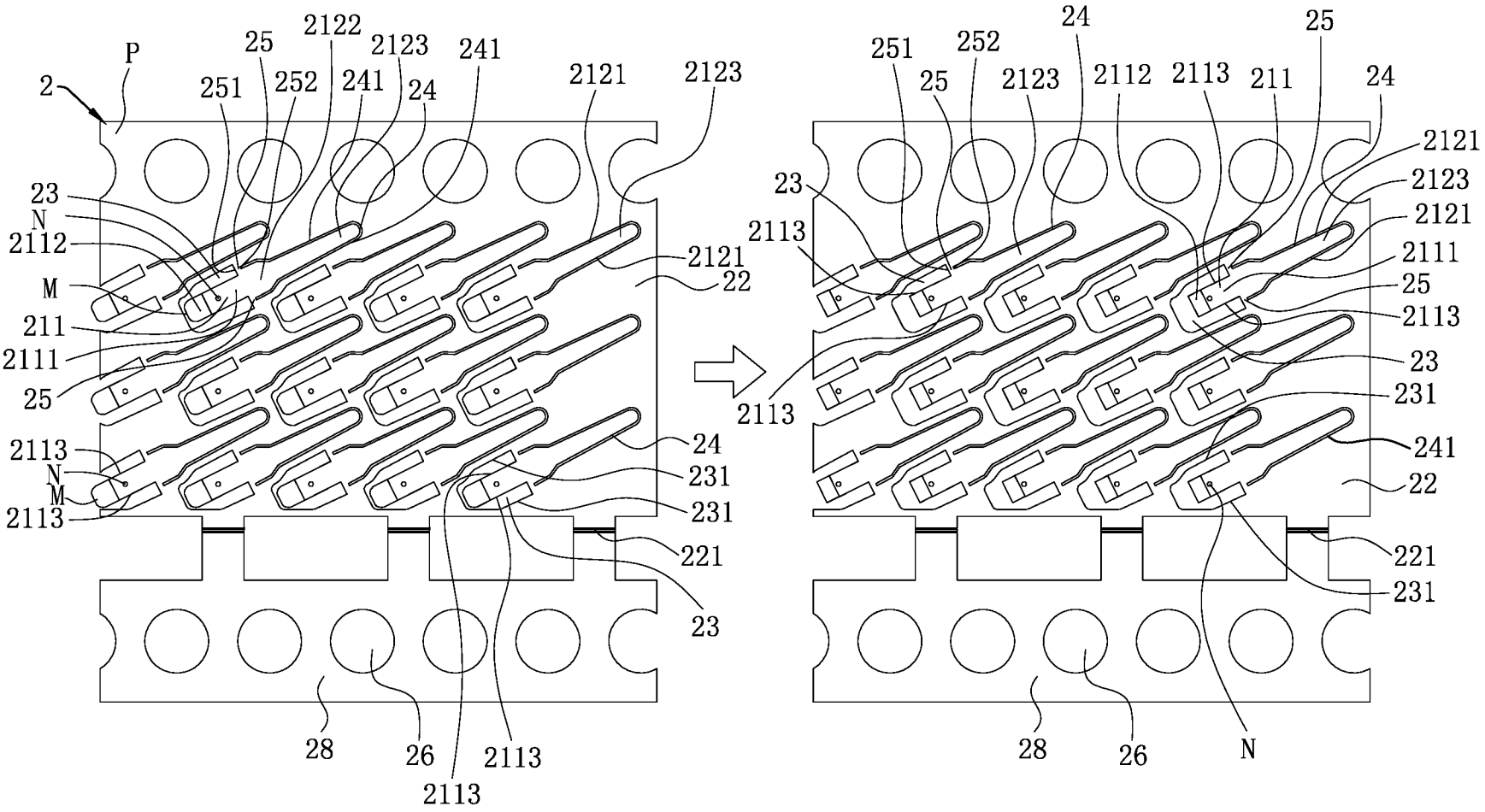
FIGS. 1 and 2 are schematic views of steps of a method of manufacturing an electrical connector according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one elements relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-10. In accordance with the purposes of this invention, as embodied and broadly described herein, this invention, in one aspect, relates to an electrical connector and a method of manufacturing the same.

Figure 3:
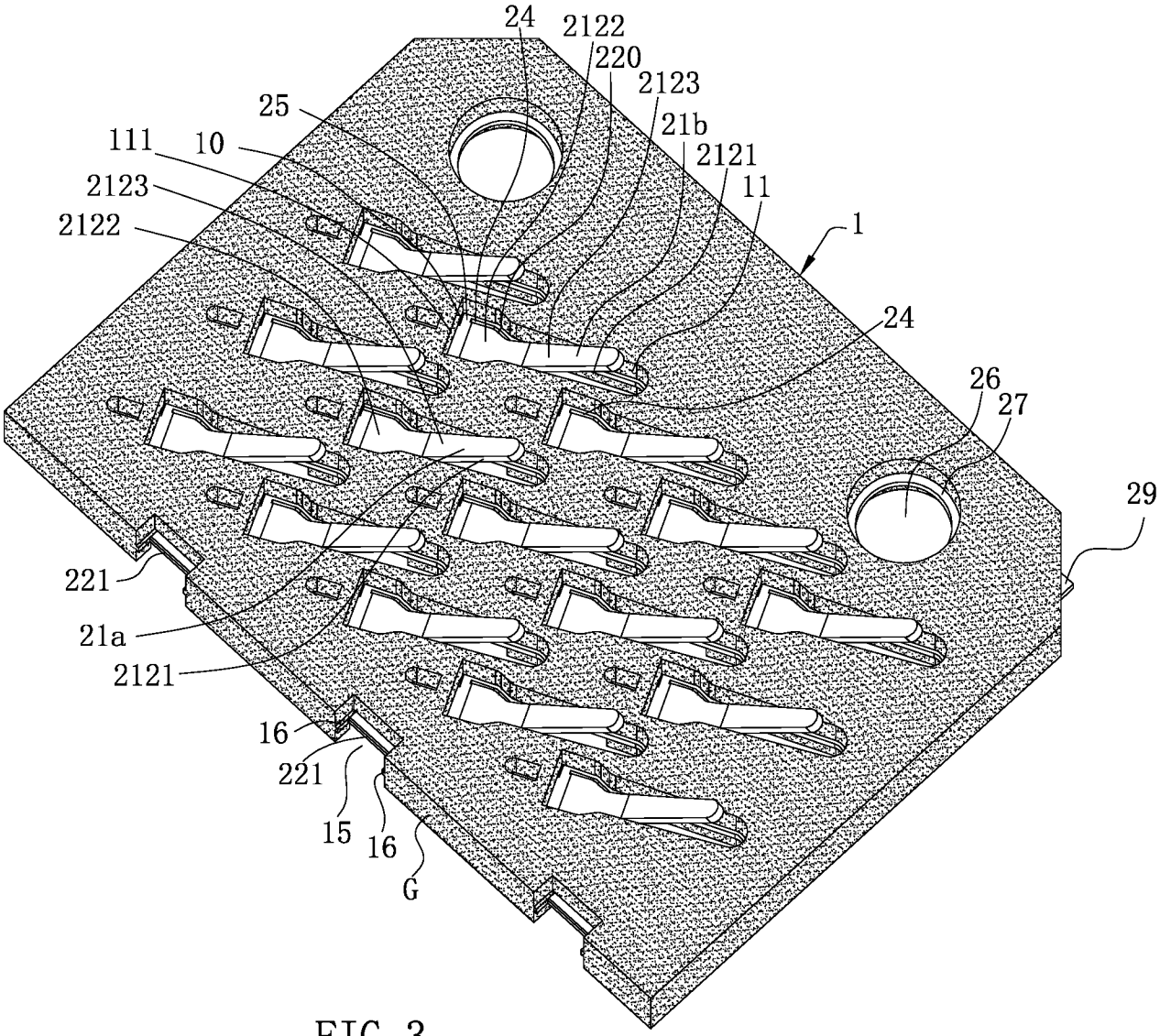
FIG. 3 is a perspective view of an electrical connector after completion of manufacturing the same according to certain embodiments of the present invention.
Figure 4:
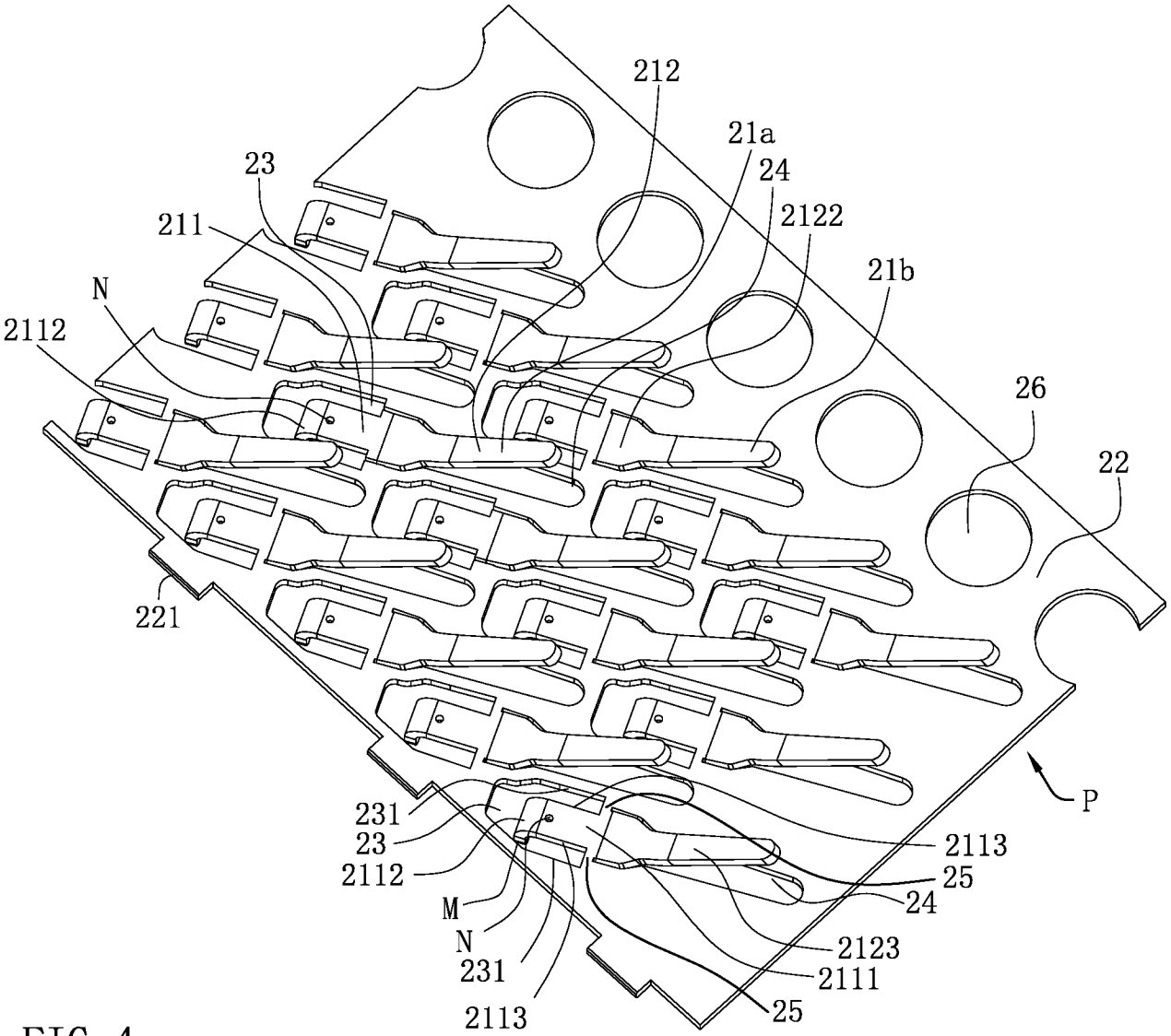
FIG. 4 is a perspective view of a metal plate after completion of manufacturing the electrical connector according to certain embodiments of the present invention.
Figure 7:
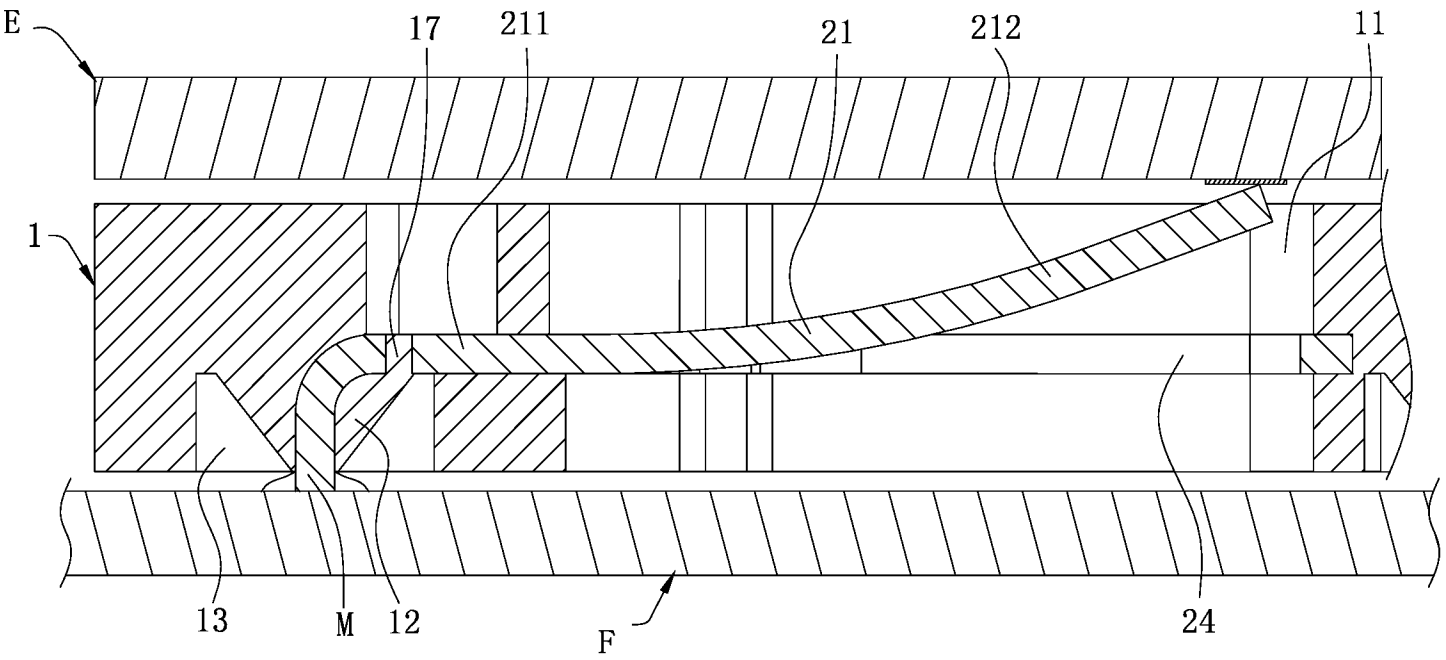
FIG. 7 is a sectional view of FIG. 6 to which the first mating component and the second mating component are connected.
Figure 8:
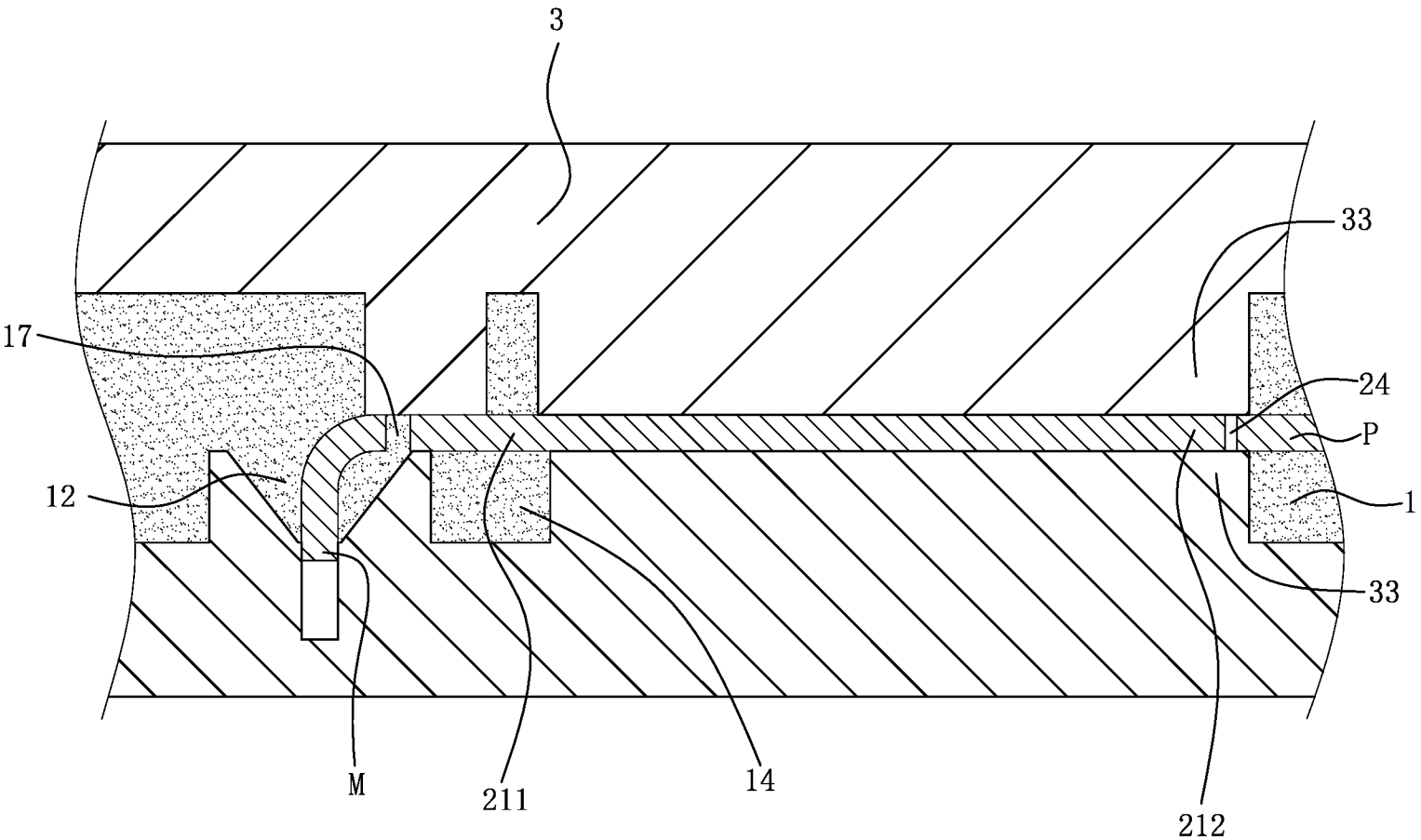
FIG. 8 is a schematic view of a pair of positioning posts of the mold clamping the elastic arm vertically and exceeding horizontally beyond the through slot according to certain embodiments of the present invention, where the insulating body and the metal sheet are sectioned along a line A-A.
Figure 9:
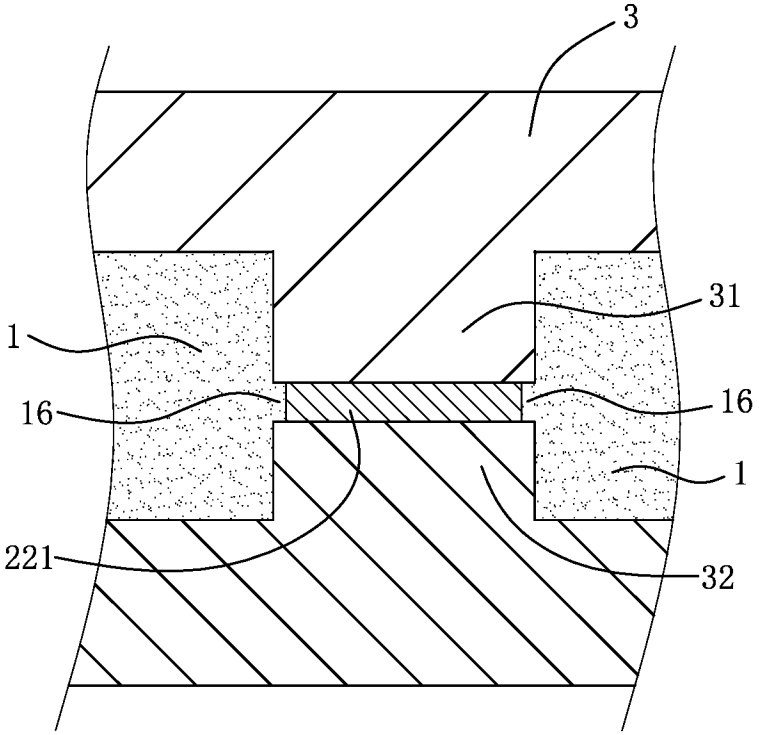
FIG. 9 is a schematic view of an upper protruding post and a lower protruding post covering an upper surface and a lower surface of a corresponding strip connecting portion according to certain embodiments of the present invention, where the insulating body and the metal sheet are sectioned along a line D-D.
Figure 10:
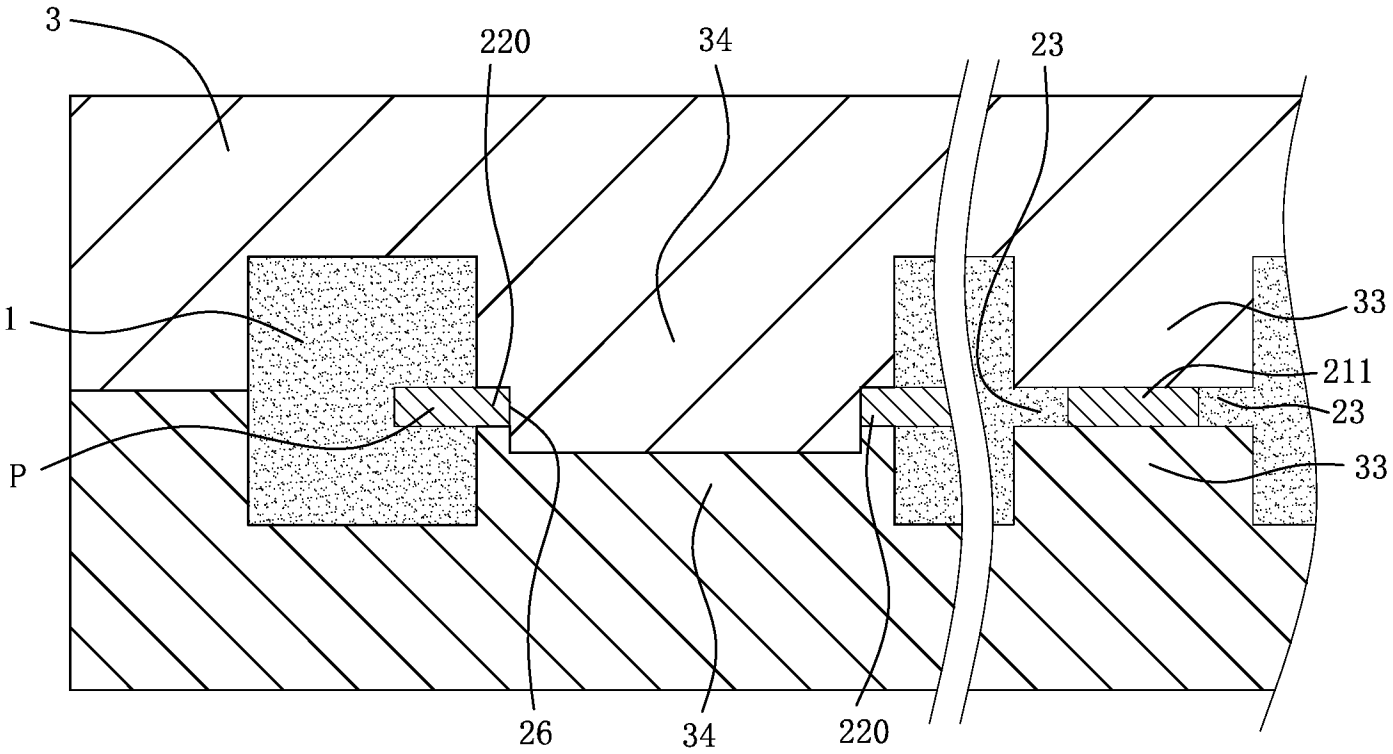
FIG. 10 is a schematic view of a pair of positioning posts of the mold covering a corresponding cutting slot, and a pair of fixing posts covering a corresponding positioning hole according to certain embodiments of the present invention, where the insulating body and the metal sheet are sectioned along a line C-C.

Referring to FIG. 3, FIG. 4 and FIG. 7, the electrical connector is used to electrically connect a first mating component E and a second mating component F, and includes: an insulating body 1, and a plurality of conductive members and a base plate 22 insert-molded with the insulating body 1. The conductive members and the base plate 22 are cut and formed altogether from a metal sheet P. The base plate 22 is provided horizontally and is accommodated in the insulating body 1. In this embodiment, the first mating component E is a chip module, the second mating component F is a circuit board, and the conductive members are terminals 21. (In other embodiments, the conductive members may be portions of the terminals 21 used to be conductively connected to one of the chip module and the circuit board.) Each terminal 21 has a base portion 211 and an elastic arm 212 connected to the base portion 211. The elastic arm 212 is used to be in contact with the chip module. The base portion 211 has a conductive portion M to be conductively connected to the circuit board. Specifically, the conductive portion M is soldered to a surface of the circuit board. (In other embodiments, the conductive portion M may be inserted into the circuit board to be soldered, or the conductive portion M and the circuit board are not soldered, e.g., the conductive portion M surface elastically abuts the circuit board.)

Figure 5:
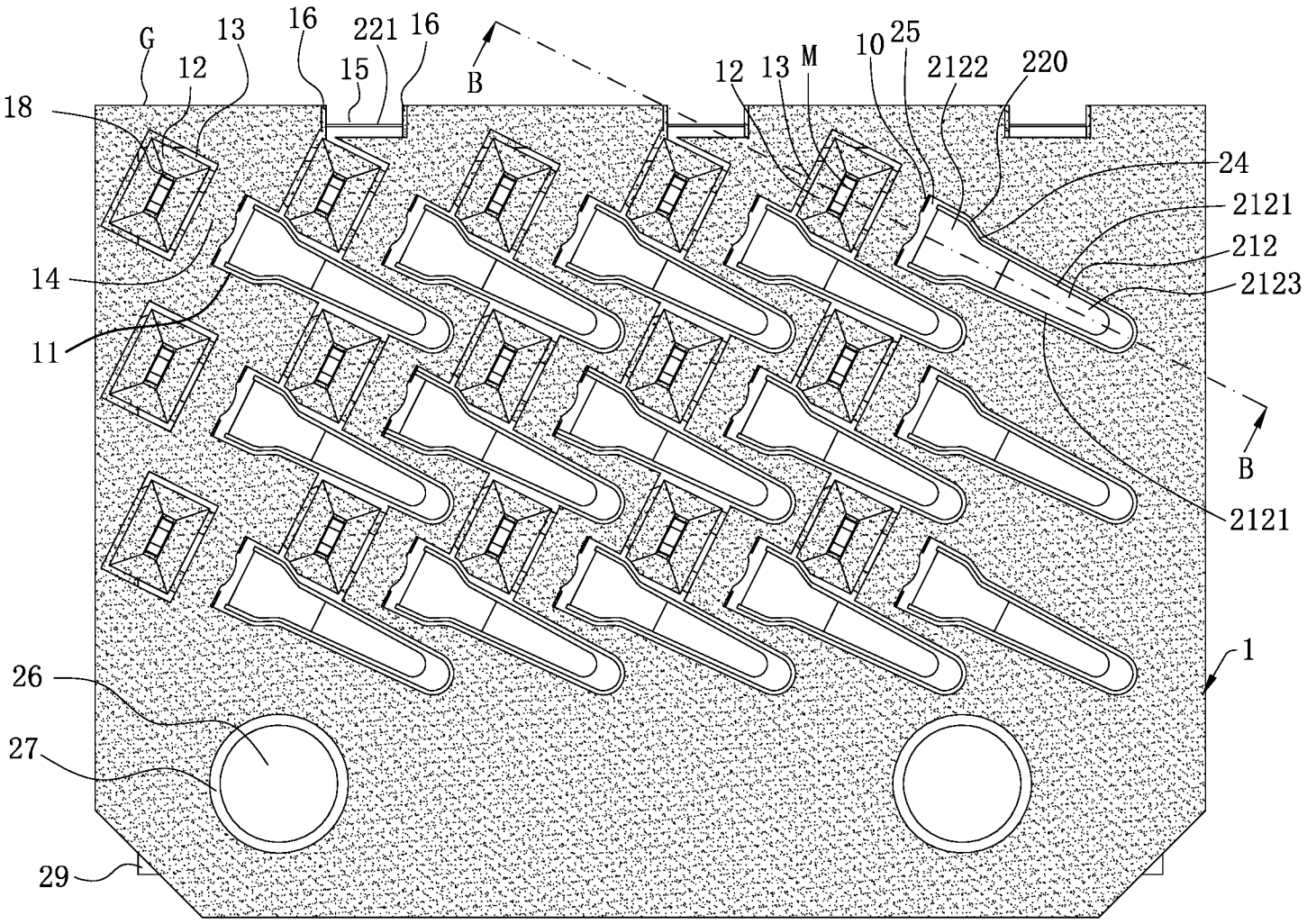
FIG. 5 is a bottom view of an electrical connector after completion of manufacturing the same according to certain embodiments of the present invention.
Figure 6:
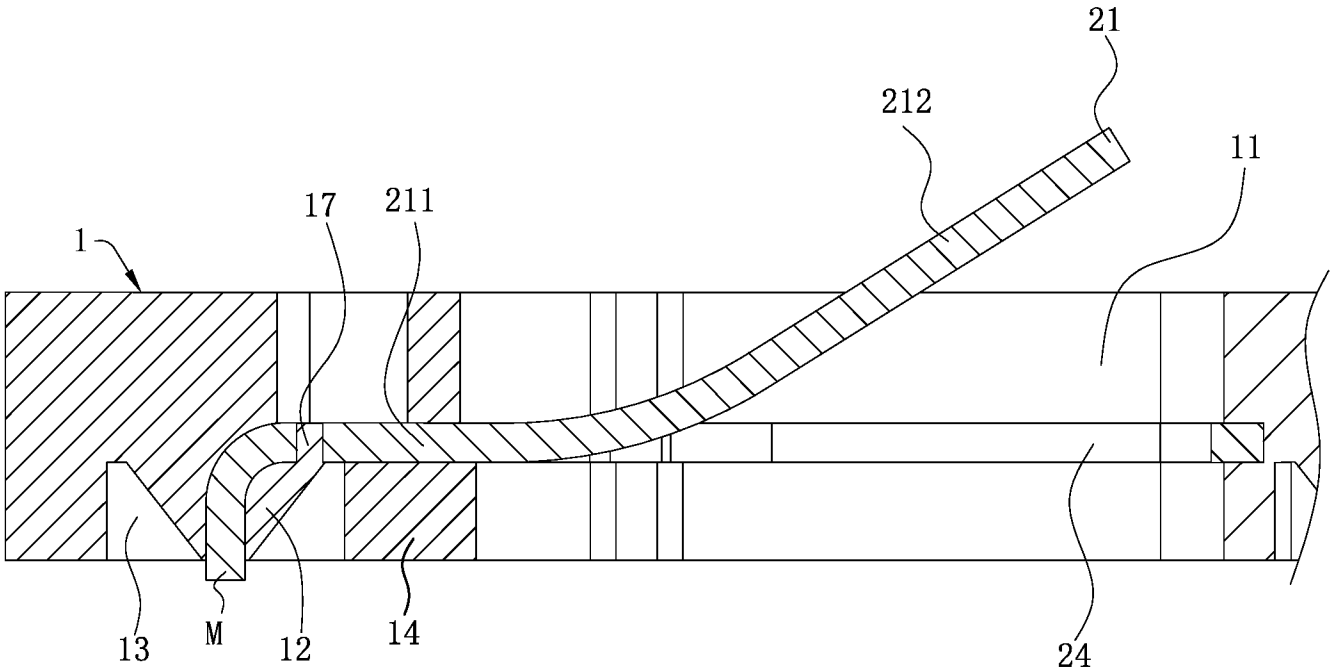
FIG. 6 is a sectional view of FIG. 5 along a line B-B.

Referring to FIG. 3, FIG. 5 and FIG. 6, the insulating body 1 is located above the circuit board. The insulating body 1 is provided with a plurality of through holes 11, and the through holes 11 run vertically through the insulating body 1. Each through hole 11 has an upper opening 111 located on an upper surface of the insulating body 1, and a protruding portion 10 protrudes from a side surface of each through hole 11 into the through hole 11. The insulating body 1 is provided with a plurality of insulating blocks 12, and each insulating block 12 gradually becomes larger along an upward direction from a bottom thereof. In this embodiment, each insulating block 12 is in a frustum shape (and in other embodiments, each insulating block 12 may be in other shapes), which is conducive to guiding the conductive portion M of the corresponding terminal 21 when the mold is clamped, thus preventing the conductive portion M from being bumped and deviating, and does not easily stick to the mold and is conducive to demolding. A slot 13 is provided around each through hole 11. The insulating body 1 is provided with a stopping block 14 between the slot 13 and the corresponding through hole 11, and a portion of the stopping block 14 protrudes into the corresponding through hole 11, such that a width of the stopping block 14 along the line B-B is increased. The insulating body 1 has an outer side edge G, and a plurality of grooves 15 are concavely provided inward from the outer side edge G and are provided at intervals. The grooves 15 run vertically through the insulating body 1. Two protruding blocks 16 protrude toward each other and inward each groove 15 from two opposite sides of each groove 15. The two protruding blocks 16 are located on a same horizontal plane, and a tail end of each protruding block 16 is flush with the outer side edge G. A plurality of protrusions 17 are provided in the insulating body 1, and each of the protrusions 17 is in a cylinder shape. (In other embodiments, the protrusions 17 may be in other shapes.) Each protrusion 17 is located above a corresponding insulating block 12 and extends into the base portion 211 of a corresponding terminal 21.

Referring to FIG. 3 to FIG. 6, in this embodiment, the terminals are arranged in a plurality of rows and a plurality of columns. The terminals 21 include a plurality of signal terminals 21*a* and a plurality of ground terminals 21*b*. The signal terminals 21*a* are separated from each other. The ground terminals 21*b* are connected altogether by the base plate 22. (In other embodiments, the ground terminals 21*b* may be separated from each other.) The base portion 211 includes a first portion 211 which is horizontal and a second portion 2112 formed by bending perpendicularly from the first portion 2111 and extending downward. An elastic arm 212 is formed by bending upward and extending from the base portion 211. The elastic arm 212 is exposed in a corresponding upper opening 111, and the elastic arm 212 protrudes upward out of the insulating body 1. Two opposite side edges of the base portion 211 along a width direction thereof (which is perpendicular to a horizontal direction as shown by the line B-B, and the horizontal direction is perpendicular to a vertical direction) are respectively defined as two first side edges 2113, and two opposite side edges of the elastic arm 212 along a width direction thereof are respectively defined as two second side edges 2121. The elastic arm 212 includes a wide portion 2122 connected to the base portion 211 and a narrow portion 2123 connected to the wide portion 2122. The narrow portion 2123 is used to be in upward contact with the chip module. A width of the wide portion 2122 is greater than a width of the narrow portion 2123, and a width of the base portion 211 is less than the width of the wide portion 2122. The base portion 211 and the narrow portion 2123 of an adjacent terminal 21 are arranged along the width direction of the base portion 211, but the base portion 211 and the wide portion 2122 of the adjacent terminal 21 are staggered. (In other words, the base portion 211 and the wide portion 2122 of the adjacent terminal 21 are not arranged along the width direction of the base portion 211.) A hole N is provided on the first portion 2111, and the hole N runs vertically through the first portion 2111. The hole N is in a circular shape. (In other embodiments, the hole N may be in other shapes.) The protrusion 17 enters the hole N, thus better fixing the terminal 21 in the insulating body 1. The first portion 2111 is partially exposed in the corresponding slot 13. When the mold is clamped, the portion of the first portion 2111 exposed in the corresponding slot 13 and the mold abut each other, thus fixing the base portion 211, and preventing the base portion 211 from deviating in the insert-molding. The second portion 2112 is surrounded by the corresponding insulating block 12, and the portion of the second portion 2112 protruding out of the insulating block 12 forms the conductive portion M. A lower surface of the insulating body 1 has a plurality of lower openings 18 to expose the conductive portion M downward. The lower end of the conductive portion M is lower than the lower surface of the insulating body 1.

Referring to FIG. 1 and FIG. 3, the base plate 22 is in a horizontal flat plate shape. The first portion 2111 and the base plate 22 are co-planar. By cutting the base portion 211, a cutting slot 23 is formed between the base portion 211 and the base plate 22. The cutting slot 23 is U-shaped and surrounds the base portion 211, and the cutting slot 23 is filled by the insulating body 1. A portion of the cutting slot 23 is exposed in the through hole 11, and the portion of the cutting slot 23 exposed in the through hole 11 is filled by the protrusion 10. A side edge of the cutting slot 23 opposite to a corresponding first side edge 2113 is defined as a third side edge 231. By cutting the elastic arm 212, a through slot 24 is formed between the base plate 22 and the elastic arm 212. The cutting slot 23 and the through slot 24 are U-shaped and are provided opposite to each other. In other words, the openings of the two U-shaped slots are provided opposite to each other. Further, the through slot 24 surrounds the base portion 211. An edge of the through hole 11 is spaced apart from the through slot 24. (In other words, a partial area 220 of the base plate 22 connecting the through slot 24 is exposed to the through hole 11.) A side edge of the through slot 24 opposite to a corresponding second side edge 2121 is defined as a fourth side edge 241. Along the width direction of the base portion 211, the third side edge 231 passes outward beyond the fourth side edge 241, and a distance between the corresponding first side edge 2113 and the third side edge 231 is greater than a distance between the corresponding second side edge 2121 and the fourth side edge 241, such that the width of the base portion 211 is reduced, further reducing the electrical capacitive effect of the base portion 2121. Referring to FIG. 4, the through slot 24 and the cutting slot 23 surrounding each signal terminal 21*a* are in communication, such that the signal terminals 21*a* are separated from each other, effectively preventing the signal terminals 21*a* from short-circuiting. The through slot 24 and the cutting slot 23 surrounding each ground terminal 21*b* are not in communication, such that the ground terminals 21*b* are connected together by the base plate 22 (and in other embodiments, the ground terminals 21*b* may be separated from each other), thus facilitating grounding protection.

Figure 2:
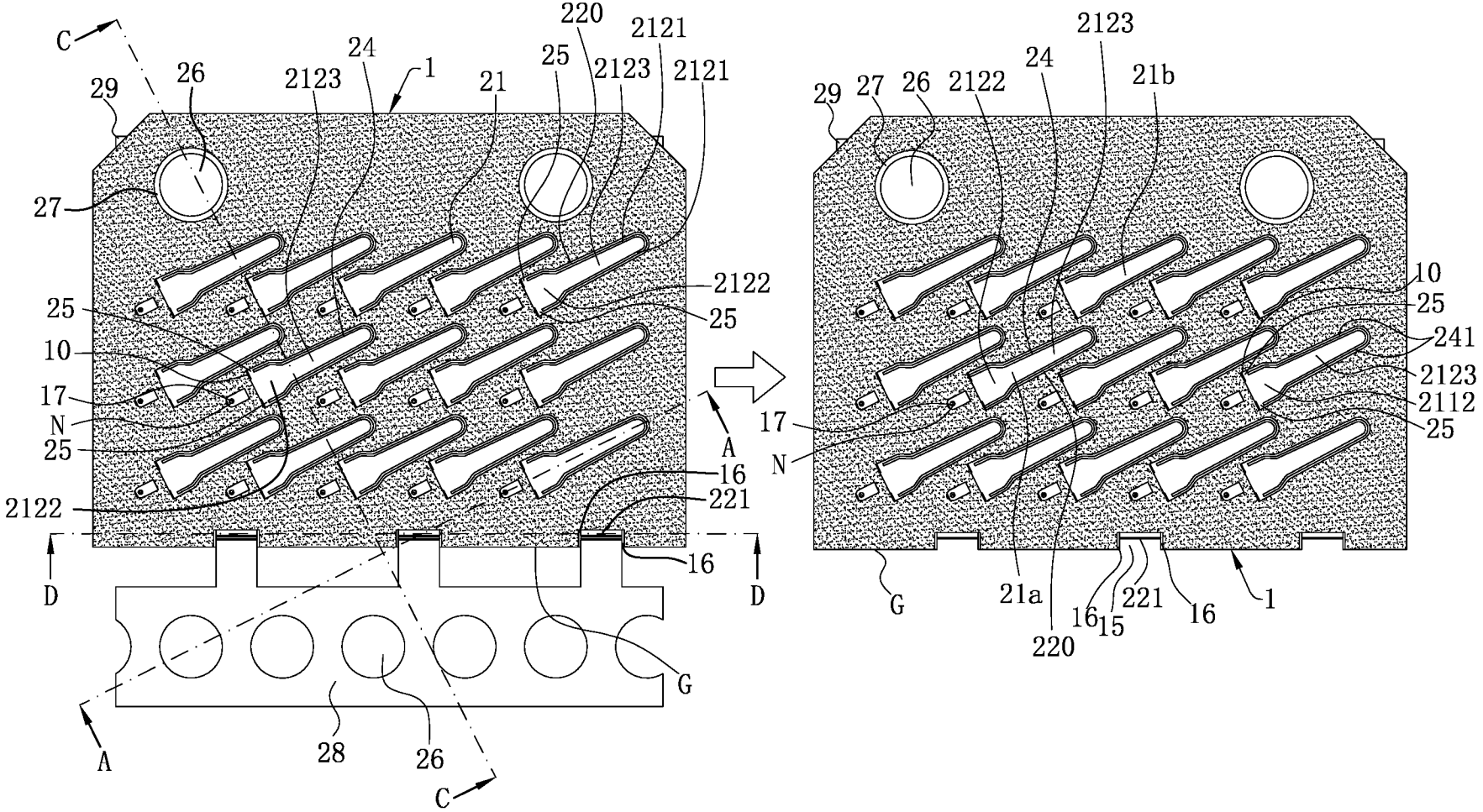

Referring to FIG. 1 and FIG. 2, the base plate 22 has a plurality of strip connecting portions 221. Prior to the insert-molding, the strip connecting portions 221 are integrally connected to a same strip 28. (In other embodiments, the strip connecting portions 221 may be provided on the terminals.) After the insert-molding, the strip connecting portions 221 are broken from the strip 28. Each strip connecting portion 221 is located in a corresponding groove 15, and the upper surface and the lower surface of each strip connecting portion 221 are exposed in the corresponding groove 15, which is conducive in that when the strip 28 is broken, the upper surface and the lower surface of each strip connecting portion 221 are not in contact with the insulating body 1, thereby preventing from the damages to the insulating body 1. The two opposite sides of each strip connecting portion 221 abut the two protruding blocks 16. An upper surface of each protruding block 16 is flush with the upper surface of each strip connecting portion 221, and a lower surface of each protruding block 16 is flush with the lower surface of each strip connecting portion 221. The tail end of each protruding block 16 is flush with the outer side edge G, and the strip connecting portions 221 do not pass beyond the outer side edge G, thus preventing the strip connecting portions 221 from being scratched by outer objects, and preventing the strip connecting portions 221 from scratching the working staffs. The two protruding blocks 16 abut the two opposite sides of each strip connecting portion 221, such that when the strip 28 is removed, the damages caused by the acting forces applied may be absorbed by the two protruding blocks 16, thus not affecting the whole structure of the insulating body 1, which is conducive to ensuring the strength and completeness of the structure of the insulating body 1.

Referring to FIG. 1 and FIG. 2, the metal sheet P has a plurality of positioning holes 26. In this embodiment, some of the positioning holes 26 are not filled by the insulating body 1, such that a partial area 27 of the metal sheet P connecting the positioning holes 26 are exposed from the insulating body 1. Further, at least one outer edge of the metal sheet P is exposed from the insulating body 1. (In other embodiments, it is possible that the outer edge of the metal sheet P is not exposed.) In this embodiment, two corners 29 of the metal sheet P are exposed from the insulating body 1. (In other embodiments, it may be other outer edges of the metal sheet P that are exposed from the insulating body 1.)

The method of manufacturing the electrical connector according to certain embodiments of the present invention includes the following steps:

Step 1, referring to FIG. 1, providing a metal plate 2, and cutting the strip 28, a plurality of positioning holes 26, a plurality of terminals 21, and a plurality of strip connecting portions 221 integrally connected to the strip 28 on the metal plate 2, thus forming a metal sheet P having the terminals 21 and the strip connecting portions 221. In other words, the metal plate 2 includes the strip 28 and the metal sheet P. Both the metal sheet P and the strip 28 have the positioning holes 26. The terminals 21 and the strip connecting portions 221 are formed on the metal sheet P. The metal sheet P is integrally connected with the strip through the strip connecting portions 221. Each positioning hole 26 is in a circular shape. Once the metal plate 2 is fixed by a jig (not shown) at the positioning holes 26, cutting the base portion 211 on the metal plate 2 (and when cutting the base portion 211 on the metal plate 2, the positioning holes 26 provide the function of positioning the metal plate 2) by a laser (not shown, same below), thereby forming the cutting slot 23 on the metal plate 2. After cutting the base portion 211, bending the base portion 211 perpendicularly downward, thereby the base portion 211 forms a first portion 2111 being horizontal and a second portion 2112 bending perpendicularly and extending downward from the first portion 2111. After cutting the elastic arm 212, forming the through slot 24 on the metal plate 2. A connecting portion 25 is formed on the metal plate 2 between the cutting slot 23 and the through slot 24 to be connected to the elastic arm 212. The narrow portion 2123 and the connecting portion 25 of the adjacent terminal 21 are arranged along the width direction of the narrow portion 2123. The connecting portion 25 has a first cutting edge 251 and a second cutting edge 252 opposite to each other. The first cutting edge 251 is connected to the cutting slot 23, and the second cutting edge 252 is connected to the through slot 24. A width of the first cutting edge 251 is less than a width of the second cutting edge 252.

Step 2, referring to FIG. 1, FIG. 2, FIG. 8 and FIG. 9, providing a mold 3. The mold 3 has a plurality of upper protruding posts 31 and a plurality of lower protruding posts 32. Placing the metal plate 2 to the mold 3, each upper protruding post 31 covers an upper surface of a corresponding strip connecting portion 221 and passes horizontally beyond two opposite sides of the corresponding strip connecting portion 221. Each lower protruding post 32 covers a lower surface of the corresponding strip connecting portion 221 and passes horizontally beyond the two opposite sides of the corresponding strip connecting portion 221. The mold 3 is provided with a plurality of pairs of fixing posts 34 (in this embodiment, there are two pairs of fixing posts 34 corresponding to two positioning holes 26 of the metal sheet P) and a plurality of pairs of positioning posts 33. A diameter of each positioning hole 26 is less than that of each fixing post 34. Each pair of the fixing posts 34 clamp the corresponding positioning hole 26 vertically. Each elastic arm 212 is clamped by a pair of positioning posts 33 vertically. When the positioning posts 33 clamp the elastic arm 212 vertically, the positioning posts 33 simultaneously cover the through slot 24 and exceed beyond the through slot 24 in the horizontal direction, and the positioning posts 33 further cover the connecting portion 25 and a portion of the cutting slot 23. Then, injecting a plastic material into the mold 3, thereby forming an insulating body 1 on the metal sheet P by insert-molding. The insulating body 1 wraps the metal sheet P. After removing the mold 3, the insulating body 1 forms the grooves 15, and the two protruding blocks 16 are formed at two opposite sides of each groove 15. The insulating body 1 forms the through holes 11, and the edge of each through hole 11 is spaced apart from the through slots 24. The connecting portion 25 and a portion of the cutting slot 23 are exposed in each through hole 11. The positioning holes 26 being clamped by the fixing posts vertically are not filled by the insulating body 1, and a partial area 27 of the metal sheet P connecting the positioning holes 26 are exposed from the insulating body 1. After the insert-molding, two corners 29 of the metal sheet P exposed from the insulating body 1 are connected to the electrodes (not shown) for electro-plating the metal sheet P.

Step 3, referring to FIG. 2, after electro-plating the metal sheet P, cutting the connecting portions 25 by the laser (and in other embodiments, it may be cutting the connecting portions 25 first and then electro-plating), and the connecting portions 25 connected to the signal terminals 21*a* are cut, such that the cutting slot 23 surrounding each signal terminal 21*a* is in communication with the through slot 24, thereby separating the signal terminals 21*a* from each other. The connecting portions 25 connected to the ground terminals 21*b* are reserved, such that the cutting slot 23 surrounding each ground terminal 21*b* is not in communication with the through slot 24, thereby allowing the ground terminals 21*b* to be connected by the connecting portions 25 (and in other embodiments, the ground terminals 21*b* may be separated from each other), thus facilitating grounding protection.

Step 4, referring to FIG. 1 and FIG. 2, after cutting the connecting portions 25, bending the elastic arm 212 upward (and in other embodiments, it may be bending the elastic arm 212 upward and then cutting the connecting portions 25), such that the elastic arm 212 protrudes upward out of the insulating body 1. By bending the elastic arm 212 upward after cutting the connecting portions 25, it is conducive to laser focusing in the cutting process, such that the cutting positions may be more accurate.

Step 5: referring to FIG. 2, cutting the strip connecting portions 221 to remove the strip 28, and the breaking position does not exceed beyond the outer side edge G of the insulating body 1.

In other embodiments, it is possible that the elastic arm 212 is cut after the insulating body 1 and the metal sheet P are insert-molded. Thus, when the elastic arm 212 of each signal terminal 21*a* is cut, it is possible to simultaneously cut the connecting portion 25 of each signal terminal 21*a*.

In sum, the electrical connector and the method of manufacturing the same according to certain embodiments of the present invention have the following beneficial effects:

1. Two protruding blocks protrude toward each other and inward each of the grooves from two opposite sides of each of the grooves, and the two protruding blocks abut two opposite sides of a corresponding strip connecting portion. When the strip is removed, the damages caused by the acting forces applied may be absorbed by the two protruding blocks, thus not affecting the whole structure of the insulating body. Each strip connecting portion is located in a corresponding groove, and the strip connecting portions do not exceed outward beyond the outer side edge, thus preventing the strip connecting portions from being scratched by outer objects, and preventing the strip connecting portions from scratching the working staffs.

2. A portion of the cutting slot is exposed in the corresponding through hole, thus reducing the volume of the electrical connector to a certain degree, which is conducive to the dense arrangement of the terminals, and the connecting portion connected to a corresponding signal terminal can be cut cleanly, preventing the terminals from being connected together and short-circuiting.

3. A distance between the corresponding one of the two first side edges and the third side edge is greater than a distance between the corresponding one of the two second side edges and the fourth side edge, such that the width of the base portion is reduced. The base portion and the narrow portion of the adjacent terminal are arranged along the width direction of the base portion, and the base portion and the wide portion of the adjacent terminal are staggered, thereby increasing the distance between the base portion and the adjacent terminal, and further reducing the electrical capacitive effect of the base portion.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to electrically connect a first mating component and a second mating component, the electrical connector comprising:

an insulating body, located above the second mating component, wherein an upper surface of the insulating body has a plurality of upper openings, a lower surface of the insulating body has a plurality of lower openings, the insulating body has an outer side edge, a plurality of grooves are concavely provided inward from the outer side edge, the grooves run vertically through the insulating body, and two protruding blocks protrude toward each other and inward each of the grooves from two opposite sides of each of the grooves; and a plurality of terminals arranged in a plurality of rows and a plurality of columns and a base plate, collectively formed by cutting from a metal sheet, wherein the terminals and the base plate are insert-molded with the insulating body, and the base plate is provided horizontally;

wherein each of the terminals has a base portion and an elastic arm connected to the base portion, the base portion is provided to be at least partially horizontal and co-planar to the base plate, the base portion has a conductive portion configured to be conductively connected to the second mating component, the conductive portion is exposed downward to a corresponding one of the lower openings, the elastic arm bends upward and is exposed upward to a corresponding one of the upper openings to be in upward contact with the first mating component, the base plate has a plurality of strip connecting portions, and prior to the insert-molding, the strip connecting portions are integrally connected to a same strip; and wherein after the insert-molding, the strip connecting portions are broken from the strip, each of the strip connecting portions is located in a corresponding one of the grooves, an upper surface and a lower surface of each of the strip connecting portions are exposed in the corresponding one of the grooves, the strip connecting portions do not exceed outward beyond the outer side edge, and two opposite sides of each of the strip connecting portions abut the two protruding blocks.

2. The electrical connector according to claim 1, wherein an upper surface of each of the protruding blocks is flush with the upper surface of each of the strip connecting portions, a lower surface of each of the protruding blocks is flush with the lower surface of each of the strip connecting portions, and a tail end of each of the protruding block is flush with the outer side edge.

3. The electrical connector according to claim 1, wherein:

the insulating body is provided with a plurality of through holes running vertically through the insulating body;

a cutting slot is formed between the base plate and the base portion by cutting the base portion, a through slot is formed between the base plate and the elastic arm by cutting the elastic arm, and the cutting slot and the through slot are respectively U-shaped and provided opposite to each other; and the elastic arm is exposed in a corresponding one of the through holes, the cutting slot is filled by the insulating body, and a portion of the cutting slot is exposed in the corresponding one of the through holes.

4. The electrical connector according to claim 3, wherein two opposite side edges of the base portion along a width direction thereof are respectively defined as two first side edges, two opposite side edges of the elastic arm along a width direction thereof are respectively defined as two second side edges, a side edge of the cutting slot opposite to a corresponding one of the two first side edges is defined as a third side edge, a side edge of the through slot opposite to a corresponding one of the two second side edges is defined as a fourth side edge, and a distance between the corresponding one of the two first side edges and the third side edge is greater than a distance between the corresponding one of the two second side edges and the fourth side edge.

5. The electrical connector according to claim 4, wherein:

the elastic arm comprises a wide portion and a narrow portion connected to the wide portion, the narrow portion is configured to be in upward contact with the first mating component, a width of the wide portion is greater than a width of the narrow portion, and a width of the base portion is less than the width of the wide portion; and the third side edge passes outward beyond the fourth side edge along the width direction of the base portion, the base portion and the narrow portion of an adjacent terminal of the terminals are arranged along the width direction of the base portion, and the base portion and the wide portion of the adjacent terminal are staggered.

6. The electrical connector according to claim 3, wherein the terminals comprise a plurality of signal terminals and a plurality of ground terminals, the through slot and the cutting slot corresponding to each of the signal terminals are in communication, the through slot and the cutting slot corresponding to each of the ground terminals are not in communication, the base plate forms a connecting portion between the through slot and the cutting slot corresponding to each of the ground terminals to be connected to the elastic arm, and an edge of each of the through holes is spaced apart from the through slot.

7. The electrical connector according to claim 1, wherein the base portion comprises a first portion being horizontal and a second portion formed by bending perpendicularly from the first portion and extending downward, the insulating body has an insulating block surrounding the second portion, the insulating body is provided with a slot around the insulating block, the first portion is partially exposed to the slot, the insulating block gradually becomes larger along an upward direction from a bottom thereof, and a portion of the second portion protruding out of the insulating block forms the conductive portion.

8. An electrical connector, configured to electrically connect a first mating component and a second mating component, the electrical connector comprising:

an insulating body, having an outer side edge, wherein a plurality of grooves are concavely provided inward from the outer side edge, the grooves run vertically through the insulating body, and two protruding blocks protrude toward each other and inward each of the grooves from two opposite sides of each of the grooves; and a metal sheet, insert-molded with the insulating body, wherein the metal sheet has a plurality of strip connecting portions, prior to the insert-molding, the strip connecting portions are integrally connected to a same strip; and after the insert-molding, the strip connecting portions are broken from the strip, each of the strip connecting portions is located in a corresponding one of the grooves, an upper surface and a lower surface of each of the strip connecting portions are exposed in the corresponding one of the grooves, the strip connecting portions do not exceed outward beyond the outer side edge, and two opposite sides of each of the strip connecting portions abut the two protruding blocks;

wherein the metal sheet is cut to form a plurality of terminals, configured to mate with at least one of the first mating component and the second mating component.

9. The electrical connector according to claim 8, wherein an upper surface of each of the protruding blocks is flush with the upper surface of each of the strip connecting portions, a lower surface of each of the protruding blocks is flush with the lower surface of each of the strip connecting portions, and a tail end of each of the protruding block is flush with the outer side edge.

10. The electrical connector according to claim 8, wherein the terminals are arranged in a plurality of rows and a plurality of columns, an upper surface of the insulating body has a plurality of upper openings, a lower surface of the insulating body has a plurality of lower openings, each of the terminals has a conductive portion configured to be conductively connected to the second mating component, the conductive portion is exposed downward to a corresponding one of the lower openings, each of the terminals further has an elastic arm configured to be in upward contact with the first mating component, and the elastic arm bends upward and is exposed upward to one of the upper openings.

11. A method of manufacturing an electrical connector, the electrical connector configured to electrically connect a first mating component and a second mating component, the method comprising:

step 1: providing a metal plate in a flat plate shape, cutting a strip and a metal sheet on the metal plate, and cutting a plurality of terminals, and a plurality of strip connecting portion integrally connected to the strip on the metal sheet, wherein the terminals are configured to mate with one of the first mating component and the second mating component;

step 2: placing the metal sheet to a mold such that each of a plurality of upper protruding posts of the mold covers an upper surface of a corresponding one of the strip connecting portions and passes horizontally beyond two opposite sides of the corresponding one of the strip connecting portions, and each of a plurality of lower protruding posts of the mold covers a lower surface of the corresponding one of the strip connecting portions and passes horizontally beyond the two opposite sides of the corresponding one of the strip connecting portions; and forming an insulating body on the metal sheet by insert-molding; and step 3: after the step 2, breaking the strip connecting portions and removing the strip, wherein a breaking position does not exceed outward beyond an outer side edge of the insulating body.

12. The method according to claim 11, wherein:

each of the terminals has a base portion and an elastic arm connected to the base portion, the elastic arm is configured to be in contact with the first mating component, and the base portion has a conductive portion to be conductively connected to the second mating component;

in the step 1, the base portion is cut on the metal sheet, thereby forming a cutting slot on the metal sheet, and the cutting slot surrounds a side edge of the base portion; and prior to the insert-molding, each pair of a plurality of pairs of positioning posts of the mold clamp the elastic arm vertically and cover a portion of the cutting slot, thereby forming a plurality of through holes on the insulating body on the insulating body after the insert-molding, and each of the through holes exposes the corresponding elastic arm and the portion of the cutting slot.

13. The method according to claim 12, wherein:

in the step 1, the elastic arm is cut on the metal sheet, thereby forming a through slot on the metal sheet, and the through slot surrounds a side edge of the base portion; and in the step 2, when the positioning posts clamp the elastic arm, the positioning posts further cover the through slot and exceed horizontally beyond the through slot, thereby separating an edge of the through hole from the through slot after the insert-molding.

* * * * *